US011976423B2

(12) United States Patent
Ellenberger

(10) Patent No.: US 11,976,423 B2
(45) Date of Patent: May 7, 2024

(54) DEVICE FOR SECURING A RAILWAY APPARATUS

(71) Applicant: MATISA MATERIEL INDUSTRIEL S.A., Crissier (CH)

(72) Inventor: Marc-Henri Ellenberger, Yverdon-les-Bains (CH)

(73) Assignee: MATISA MATERIEL INDUSTRIEL S.A., Crissier (CH)

( * ) Notice: Subject to any disclaimer, the term of this patent is extended or adjusted under 35 U.S.C. 154(b) by 966 days.

(21) Appl. No.: 16/962,382

(22) PCT Filed: Jan. 15, 2019

(86) PCT No.: PCT/EP2019/050884
§ 371 (c)(1),
(2) Date: Jul. 15, 2020

(87) PCT Pub. No.: WO2019/138124
PCT Pub. Date: Jul. 18, 2019

(65) Prior Publication Data

US 2021/0062433 A1 Mar. 4, 2021

(30) Foreign Application Priority Data

Jan. 15, 2018 (FR) ..... 1850298

(51) Int. Cl.
*E01B 29/02* (2006.01)
*B61D 3/16* (2006.01)
(Continued)

(52) U.S. Cl.
CPC ..... *E01B 29/02* (2013.01); *B61D 3/16* (2013.01); *B61D 15/00* (2013.01); *B61D 45/007* (2013.01)

(58) Field of Classification Search
CPC ..... E01B 29/02; B61D 3/16; B61D 15/00; B61D 45/007
See application file for complete search history.

(56) References Cited

U.S. PATENT DOCUMENTS 3,779,403 A * 12/1973 Young ..... B66F 9/07 414/281
3,811,579 A * 5/1974 Black ..... B65G 67/20 414/500
(Continued)

FOREIGN PATENT DOCUMENTS

CN 107142798 9/2017
EP 3070203 9/2016
(Continued)

OTHER PUBLICATIONS

PCT/EP2019/050884, Apr. 11, 2019, International Search Report and Written Opinion.

*Primary Examiner* — Scott A Browne
(74) *Attorney, Agent, or Firm* — RAY QUINNEY & NEBEKER P.C.; Paul N. Taylor

(57) ABSTRACT

A device for securing a railway apparatus, comprising a support platform and a mechanism for securing the apparatus on the platform, the securing mechanism comprising:—at least one guiding slide extending in a longitudinal direction, supported by the support platform; and—a member for attaching the apparatus to the platform capable of moving along the guiding slide. The securing mechanism also comprises an upper beam supporting the guiding slide and a lower beam, connected by means of a connecting member so as to be movable in a direction perpendicular to the longitudinal direction of the guiding slide. Moreover, the securing mechanism comprises locking mechanism configured to
(Continued)

prevent the movement of the upper beam with respect to the lower beam in said perpendicular direction.

20 Claims, 7 Drawing Sheets

(51) Int. Cl.
*B61D 15/00* (2006.01)
*B61D 45/00* (2006.01)

(56) References Cited

U.S. PATENT DOCUMENTS

| | | | | |
|---|---|---|---|---|
| 4,274,334 | A * | 6/1981 | Lund | E01B 29/16 104/5 |
| 11,091,883 | B2 * | 8/2021 | Ganz | E01B 29/02 |

FOREIGN PATENT DOCUMENTS

| | | |
|---|---|---|
| FR | 3024470 | 2/2016 |
| FR | 3046588 | 7/2017 |
| FR | 3049963 | 10/2017 |
| WO | WO2014/154624 | 10/2014 |
| WO | 2015/187843 | 12/2015 |
| WO | 2016/146233 | 9/2016 |

* cited by examiner

DEVICE FOR SECURING A RAILWAY APPARATUS

TECHNICAL HELD OF THE INVENTION

The invention relates to a device for securing a railway apparatus, in particular a switch. It also relates to a transport vehicle, in particular a wagon, incorporating such a securing device.

PRIOR ART

Document FR3024470 describes a wagon for transporting a railway apparatus, comprising a support platform for the railway apparatus, having a support surface for the railway apparatus, the support platform being movable between a horizontal loading position and an inclined transport position. The railway apparatus is attached to the support platform by means of a securing mechanism formed of individual flanges distributed over the entire railway apparatus and arranged between the railway apparatus ties and the platform.

Such a particularly simple attachment method, however, has the disadvantage of requiring access to the loading platform to manually tighten the flanges, i.e. before the railway apparatus is secured. Specific precautions are therefore necessary for handling both in the loading and unloading phases, in order to ensure the safety of personnel.

In order to enable the railway apparatus to be attached to the platform without the need to access the platform, since 2006 the company MATISA SA has placed on the market at least one railway apparatus securing mechanism comprising attachment bars, carrying at one end a hook intended to be engaged with part of a foot of a rail of the railway apparatus. Each bar is mounted slidingly in a sleeve articulated to the platform so as to pivot about a longitudinal axis which is perpendicular to the bar. The operator can thus manoeuvre the bar in the manner of a lever, holding it by its free end opposite the hook so as to pivot it until the hook approaches the foot of the rail, while adjusting the useful length of the bar by sliding it in the sleeve. Once the hook is engaged with the foot of the rail, all that remains to be done is to block the sliding of the bar in the sleeve to lock the hook and the railway apparatus in position relative to the platform. The length of the bar allows the operator to act while remaining at a distance from the hook to the side of the platform. The system thus described is very similar to the system illustrated in document W02014154624A1. It is effective, but does not provide a significant clamping force between the hook and the railway apparatus, particularly because the force applied by the hook to the foot of the rail during installation and securing is in the general direction of the bar, slightly oblique to the horizontal, and therefore with a strong horizontal component that tends to cause the railway apparatus to slide on the platform. This device is also difficult to motorize.

To remedy this, document FR1653185 proposes a railway apparatus securing device comprising a support platform of which the securing mechanism comprises a carriage guided by a guiding slide, means for blocking the carriage relative to the rail, and members for locking the guiding slide with respect to the platform. The locking members comprise, in particular, a bevelled shim engaging with a corresponding inclined wall of a locking cavity formed in the support platform. Such a device is simple to motorize and allows safe handling of the railway apparatus because the movement of the attachment member is broken down into at least two components, namely a horizontal movement and a vertical movement, thanks to the bevelled shape of the shim. However, the construction of the bevelled shim and the associated locking cavity can be complex.

DISCLOSURE OF THE INVENTION

The object of the invention is to overcome the disadvantages of the prior art by proposing a device for securing a railway apparatus that allows simple and safe handling of the railway apparatus and that is simple to motorize, but also to construct. Another object of the invention is to precisely adjust the height of the attachment mechanism to accommodate different tie heights, such as wooden ties (short) or concrete ties (taller).

For this purpose, the invention relates to a device for securing a railway apparatus, comprising a support platform for the railway apparatus and at least one mechanism for securing the railway apparatus on the support platform, said securing mechanism being capable of moving from a locking position to an unlocking position and vice versa, the securing mechanism comprising:

- at least one guiding slide extending in a longitudinal direction;
- at least one member for attaching the railway apparatus to the support platform,
- which member is capable of moving along the guiding slide;

characterized in that the securing mechanism also comprises:

- an upper beam supporting the guiding slide; and
- a lower beam connected to the support platform, the upper beam and the lower beam being connected by means of at least one connecting member configured such that the upper beam is movable relative to the lower beam in a direction perpendicular to the longitudinal direction of the guiding slide, and in that the securing mechanism comprises means for locking said at least one connecting member, said locking means being configured to prevent the movement of the upper beam with respect to the lower beam.

Thanks to the invention, the movement of the attachment member is always broken down into at least two components, namely a movement of the connecting member in the longitudinal direction of the slide, and a movement of the upper beam in a direction perpendicular to the longitudinal direction of the slide. However, unlike the prior art, the mechanism allowing this breakdown of the movement into two components is much simpler to manufacture and use. Indeed, two separate mechanisms allow these movements in two different directions, and not just one as in the prior art.

Furthermore, since it is the upper beam supporting the guiding slide along which the attachment member moves, the height of the attachment mechanism can be easily precisely adjusted to accommodate different tie heights.

According to a particular embodiment of the invention, the connecting member is an assembly forming an articulated parallelogram comprising at least one transmission rod connected to the upper beam and a transfer lever connected to the lower beam and controlled by a screw and nut assembly or a cylinder, so that the movement of the upper beam is kinematically linked to the movement of the screw in the nut or, correspondingly, of the cylinder rod in the cylinder body. This choice of connecting element makes it possible to limit the overall dimensions and to obtain a good distribution of the forces between the lower beam and the upper beam.

According to another particular embodiment of the invention, the connecting member is a screw and nut assembly, for example of trapezoidal shape, the screw of which is carried by the lower beam and the nut of which is carried by the upper beam, so that the movement of the upper beam is kinematically linked to the movement of the nut along the screw and the locking is ensured by the tightening torque of the screw and nut assembly. The screw or the cylinder are in fact inexpensive and particularly simple connecting elements. The movement of the screw in the thread or of the cylinder in the cylinder body also allows precise control of the movement of the upper beam.

In order to be able to absorb the difference in height of the different models of concrete or wooden railway apparatuses with the securing device, the travel of the upper beam is at least 130 mm.

Preferably, the securing mechanism comprises two upper beams connected to a lower beam, two guiding slides, and two connecting members connecting an upper beam each to the lower beam, the connecting members being capable of being controlled independently. Thus, both ends can be hooked independently, thus avoiding an overhang, the hook clamping force being constant regardless of the position of the hook in the guiding slide. This relieves the user of additional vigilance and allows him to pay less attention. This thus increases the operating safety.

To facilitate the use of the device, the attachment member is moved along the guiding slide by a drive mechanism, which preferably is self-locking, to provide additional safety to the device.

According to a preferred embodiment of the invention, the drive mechanism comprises a movable chain capable of moving along the guiding slide, which chain is driven by at least two sprockets so that the movable chain forms a loop. The drive by means of a movable chain makes it possible to obtain a naturally self-locking mechanism, which is simple to manufacture and implement.

According to a particular embodiment, having the advantage of being simple to use, said at least one of the sprockets, called the drive wheel, is provided with a drive shaft, said drive shaft being connected to a motor so as to drive the drive wheel in rotation about said drive shaft.

According to a preferred embodiment of the invention, in order to provide additional safety to the device, the drive wheel is provided with a braking system for preventing rotation of the drive wheel about its drive shaft.

According to a preferred embodiment of the invention, the braking system is of the failsafe type, and comprises, for example, a pair of brake discs. Thus, by default, i.e. without power, the braking system prevents the rotation of the drive wheel about its drive shaft. It is therefore necessary to supply power to the braking system to release the brake.

According to a preferred embodiment of the invention, which is simple for operators to implement and use, the support platform is movable between the loading position and an inclined transport position, preferably by rotation about at least one horizontal pivot axis.

According to a preferred embodiment of the invention, so as to eliminate any muscular effort for the operator, the securing mechanism is controlled by a remote control or an emergency remote control in the event of failure of the primary remote control.

Preferably, the attachment mechanism is configured to be pivotable about an axis normal to the plane of the support platform, the pivoting of the attachment mechanism being provided for example by drive means comprising cylinders. This allows the position of the attachment mechanism to be adjusted in order to compensate for possible misalignments.

The invention also relates to a vehicle for transporting a railway apparatus, in particular a wagon for transporting a railway apparatus, characterised in that said vehicle comprises a securing system according to the invention mounted on a transport chassis supported by a running gear.

BRIEF DESCRIPTION OF THE DRAWINGS

Further features and advantages of the invention will become clear from the following description, which is given with reference to the accompanying drawings, in which.

DETAILED DESCRIPTION OF EMBODIMENTS

Figure 1:
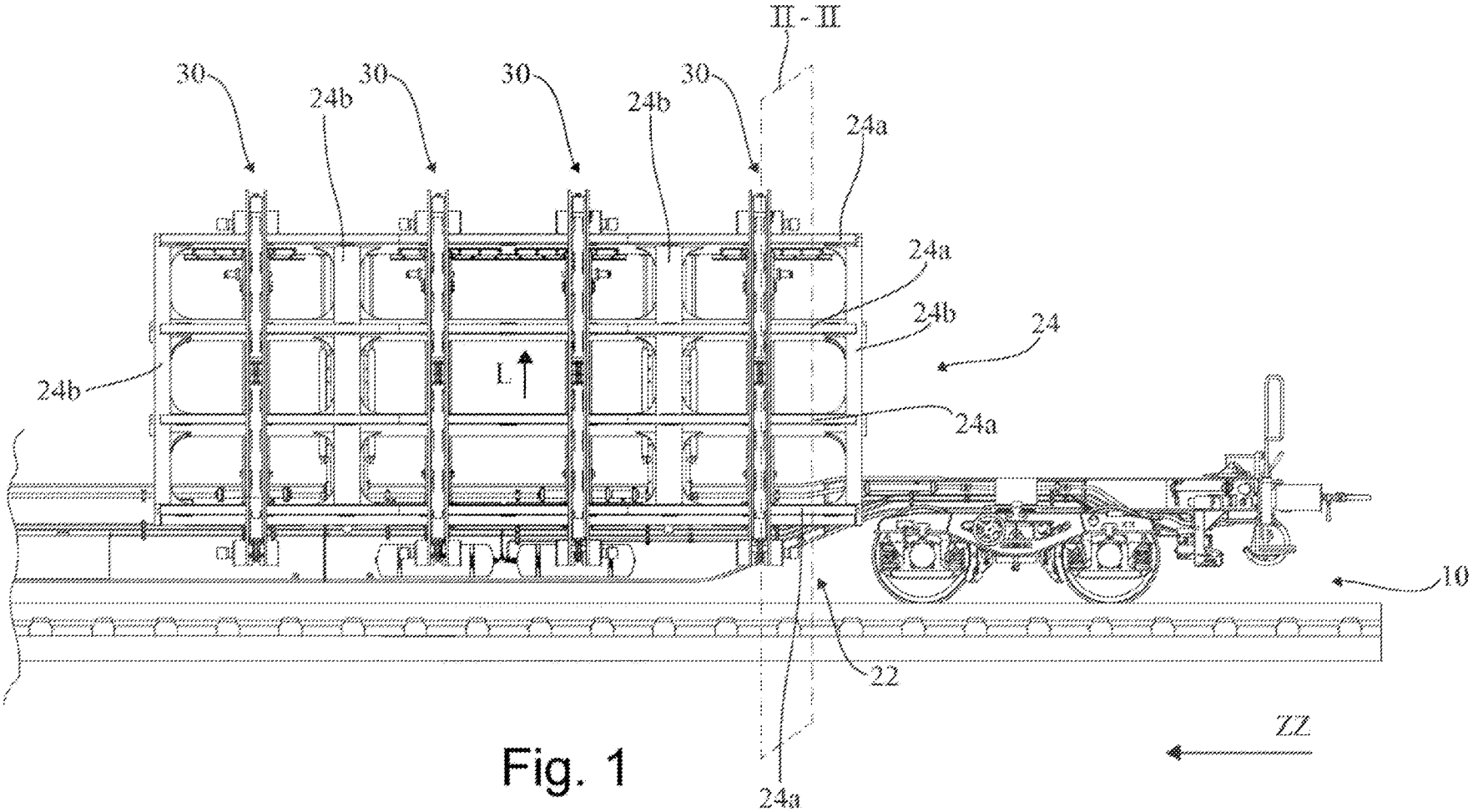
FIG. 1 shows a wagon for transporting a railway apparatus, said wagon incorporating a device for securing the railway apparatus in accordance with an embodiment of the invention, the device for securing the railway apparatus being in a transport position.
Figure 3:
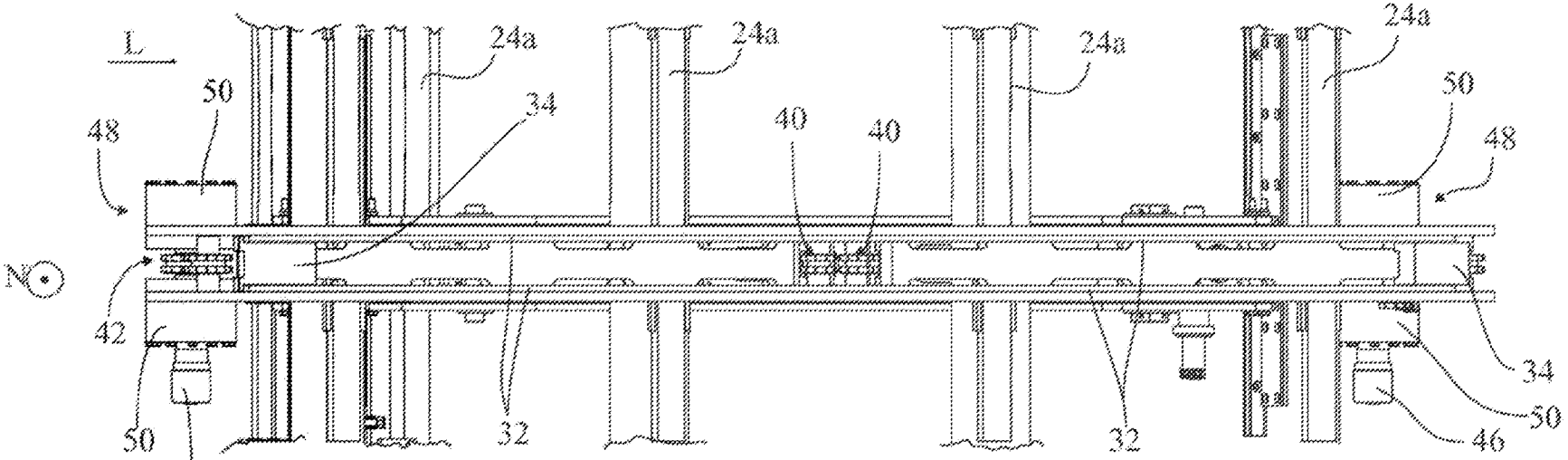
FIG. 3 is a view similar to FIG. 2 of the securing device of FIG. 1, the upper beam of which is in a first position.

FIG. 1 shows a transport wagon 10 being loaded with a railway apparatus 12 (visible in FIG. 3) of large dimensions, in particular of a width greater than the clearance margin 14 prescribed for rail transport. The railway apparatus 12 is, for example, as shown in FIG. 3, a switch comprising rails 16 and switch ties 18.

Figure 2:
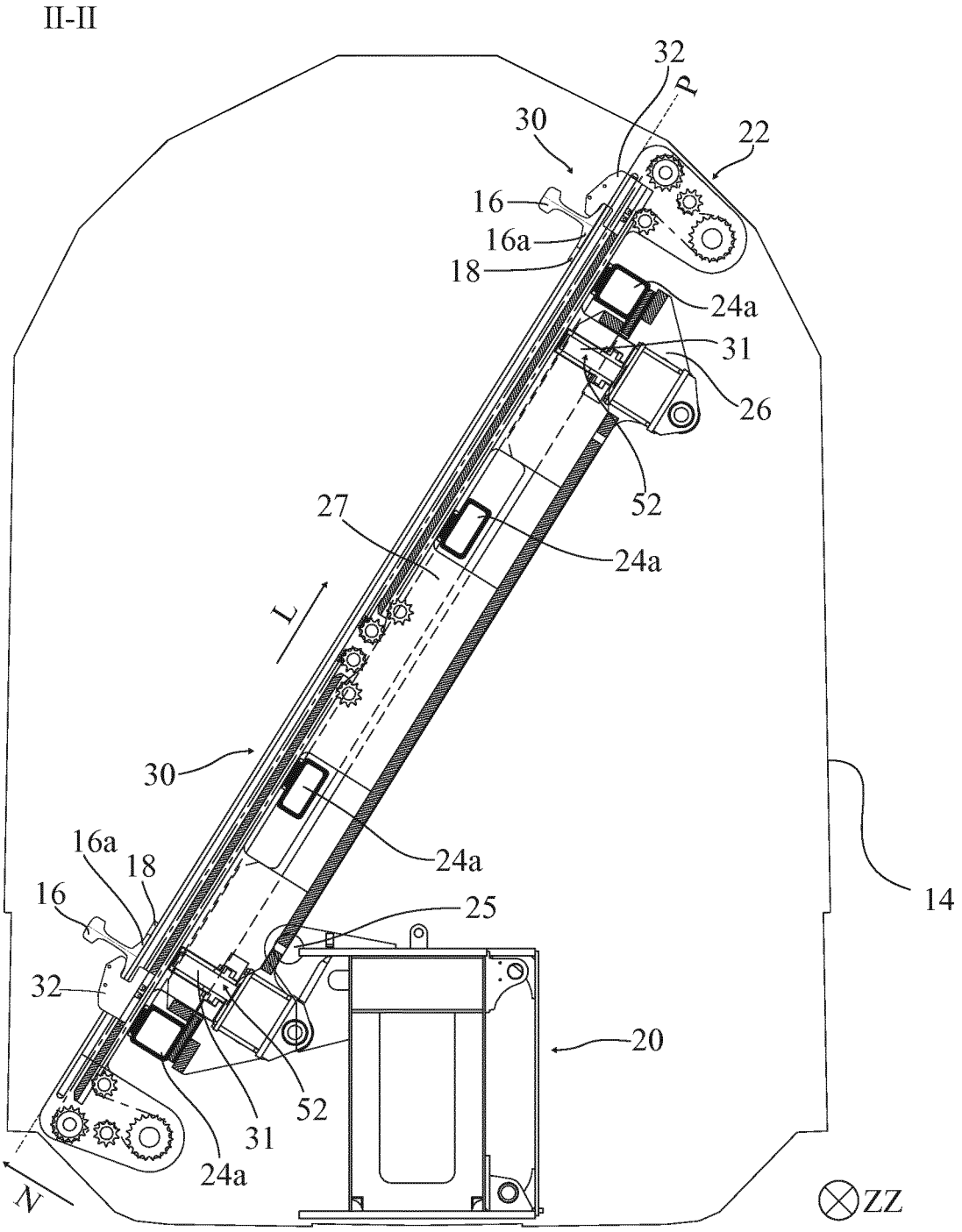
FIG. 2 is a section according to line II-II of FIG. 1.

As can be seen in FIG. 2 in particular, the transport wagon 10 has a chassis 20 whose width is less than or equal to the width of the clearance margin 14. The securing of the railway apparatus 12 to the transport wagon is ensured by a securing device 22 comprising a support platform 24 of the railway apparatus 12 hinged to the chassis 20 by means of a joint 25 allowing pivoting about a horizontal axis parallel to the longitudinal axis ZZ of the chassis 20, which is itself normal to the plane of FIG. 2.

In FIGS. 1 and 2, the support platform 24 is inclined with respect to a reference plane parallel to the plane of the track on which the transport wagon 10 runs. One or more hydraulic cylinders (not shown), or any other type of motorised actuator, are used to pivot the tiltable support platform 24 between a loading position, shown in FIG. 3, in which the support platform 24 is in a loading plane P (shown as a dotted line in FIGS. 3 and 5 to 11, and which corresponds to the plane in FIG. 4), and an inclined transport position shown in FIGS. 1 and 2.

The support platform 24 is preferably in two or more parts in order to make the structure of the securing device 22 less rigid. In this case, the support platform 24 is preferably a mechanically welded structure. It comprises stringers 24*a* and crossmembers 24*b* with at least one securing mechanism 30 mounted on them. This complete assembly can either be in a raised position (FIG. 2) or can be pivoted about the joint 25 to a horizontal position for loading and unloading. The securing device 22 furthermore comprises a securing mechanism 30 comprising a lower beam 26 and an upper beam 27 connected to the support platform 24. The securing mechanism 30 is designed to secure the railway apparatus 12 to the support platform 24.

In the embodiment illustrated in the figures, in particular in FIGS. 1 to 9, the securing device 22 comprises four securing mechanisms 30. It should be noted that the securing device 22 may comprise fewer or more securing mechanisms as required, particularly depending on the number and size of the railway apparatuses to be transported.

Here, the securing mechanisms 30 can be moved on the platform 24 along the longitudinal axis ZZ of the chassis 20 independently of each other. This makes it possible to adapt to various loading or transport requirements as well as to the dimensions or shape of the railway apparatuses to be transported.

The upper beam 27 and the lower beam 26 are connected by means of at least one connecting member 31. This connecting member 31 is configured so that the upper beam 27 is movable relative to the lower beam 26 in a direction N perpendicular to the longitudinal direction L of a guiding slide 32 carried by the upper beam 27, which will be described later. In particular, the upper beam 27 and the lower beam 26 are connected by means of two connecting members 31 arranged on either side of a plane of symmetry S of the support platform 24, which is normal to the loading plane P.

As will be detailed below, each securing mechanism 30 is capable of moving between a locked position, in which the railway apparatus 12 is reliably secured to the support platform 24, and an unlocked position, in which the railway apparatus 12 can be released from the support platform 24.

For this purpose, each securing mechanism 30 comprises a guiding slide 32, supported by the upper beam 27, extending in a longitudinal direction L, supported by the support platform 24. In particular, the longitudinal direction L of the guiding slide 32 is, when the support platform 24 is in the loading position, perpendicular to the longitudinal axis of the chassis 20 or to the track axis, while being contained in the free plane formed by the support platform 24.

Each securing mechanism 30 also comprises attachment members 34 for attaching the railway apparatus 12 to the support platform 24, which attachment members are capable of moving along these guiding slides 32. In the embodiment illustrated in the drawings, the attachment members 34 are hooks.

As can be seen in FIG. 3, each attachment member 34 or hook has a hooking area 35 intended to engage with the foot 18*a* of one of the rails 18 of the switch 16.

A drive mechanism 36 is associated with each attachment member 34 and allows its movement along the associated guiding slide 32. This drive mechanism 36 is preferably self-locking, to prevent any unintentional movement of the attachment member 34, especially when the transport wagon 10 is moving.

Figure 4:
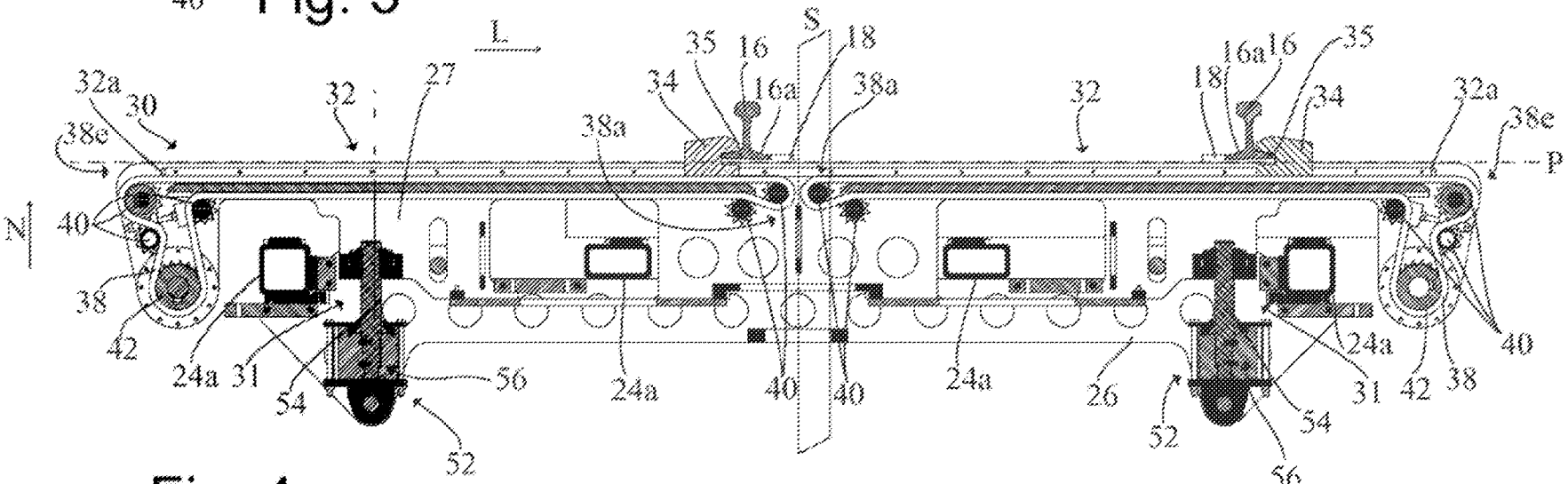
FIG. 4 is a plan view of a detail of the securing device of FIG. 1, the chains of which have been omitted.

In the embodiment shown in the drawings, and as can be seen in particular in FIGS. 3 and 4, each drive mechanism 36 here comprises a movable chain 38 capable of moving along the guiding slide 32, to which the attachment member 34 is connected. In particular, each chain 38 is guided by the associated guiding slide 32 in such a way that the attachment member 34 can be moved along the guiding slide 32. The guiding slide 36 thus defines a linear, and preferably rectilinear, path for the attachment member 34. This path is contained in the loading plane P. In practice, the slide 36 here consists of a rail with a generally U-shaped cross-section, thus forming a groove along which the chain 38 can be moved.

Each chain 38 is driven by at least two sprockets 40, in particular in such a way that the chain 38 forms a loop. In the embodiment illustrated in the drawings, there are six sprockets 40. Two sprockets 40 are arranged at a first end 38*a* of the loop which is closest to the centre of the platform 24, and four at the opposite end 38*e* of the loop which is closest to the free end 32*a* of the guiding slide 32.

One of these sprockets 40, called a drive wheel 42, is provided with a drive shaft 44 connected to a motor 46, for example a hydraulic motor, so as to drive the drive wheel 42 in rotation about this drive shaft 44. The diameter of the drive wheel 42 is larger than that of the other sprockets 40 to facilitate driving by the motor 46.

The drive wheel 42 is arranged here at the end 38*e* of the loop and is also arranged lower than the other sprockets 40, i.e. closer to the track on which transport wagon 10 runs in the loading position. It should be noted that the arrangement and number of sprockets 40 can, of course, vary. For example, it could be envisaged that there is only one sprocket 40 at each end of the loop formed by the chain 38. It is also possible to place the drive wheel 42 at the end 38*a* of the loop rather than at the end 38*e*.

The drive wheel 42 is equipped with a braking system 48 to prevent rotation of the drive wheel 42 about its drive shaft 44. Preferably, the braking system 48 is of the failsafe type and comprises, for example, a pair of brake discs 50. The brake discs are arranged on either side of the drive wheel 42, as shown in FIG. 4, where, for reasons of clarity, the chain 36 has been omitted.

The braking system 48 is configured so that, without power, it prevents the rotation of the drive wheel 42 about its shaft. In other words, it is necessary to supply power to the braking system 48 to release the brake discs 50. As this type of braking system is known per se to a person skilled in the art, it will not be described in greater detail here.

As the securing mechanism 30 is self-locking, the position of the attachment member 34 is blocked in the longitudinal direction of guiding slide 32. It is therefore prevented from moving in a first direction. More specifically, the chain 38 cannot move along the guiding slide 32 without, on the one hand, disengaging the braking system 50 and, on the other hand, driving the drive wheel 42 via the motor 46. A double locking safeguard device is therefore provided to prevent the movement of the attachment member 34 in the longitudinal direction of the guiding slide 32.

The securing mechanism 30 further comprises locking means 52 of the connecting member 31, configured to prevent movement of the upper beam 27 with respect to the lower beam 26.

Preferably, as shown in FIGS. 3 to 9, the connecting member 31 is a screw and nut assembly 52, for example of trapezoidal cross-section, carried by the upper beam 27, so that the movement of the upper beam 27 is kinematically linked to the movement of the nut 56 along the screw 54 and the locking is ensured by the tightening torque of the screw and nut assembly 52. In this particular embodiment, the locking means 52 are thus formed by the tightening of the screw 54 in the nut 56 carried by the lower beam 26. Of course, the cross-sectional shape of the screw 54 may differ.

By tightening the screw and nut assembly 52, the upper beam 27 is prevented from moving with respect to the lower beam 26 in a direction perpendicular to the guiding slide 32, which is also normal to the loading plane defined by the free surface of the support platform 24 (this plane being shown schematically by the dotted line P in FIG. 3). Since the hooking zone 35 of the attachment member 34 is in planar contact with the foot of the rail 16*a* in a plane normal to this direction, the position of the attachment member 34 is thus locked in a second direction perpendicular to the longitudinal direction of the guiding slide 32.

Moving and tightening of the screw and nut assembly 52 can be carried out by means of drive means known per se to a person skilled in the art, in particular by means of a motor. These are therefore not described in detail here.

Figure 5:
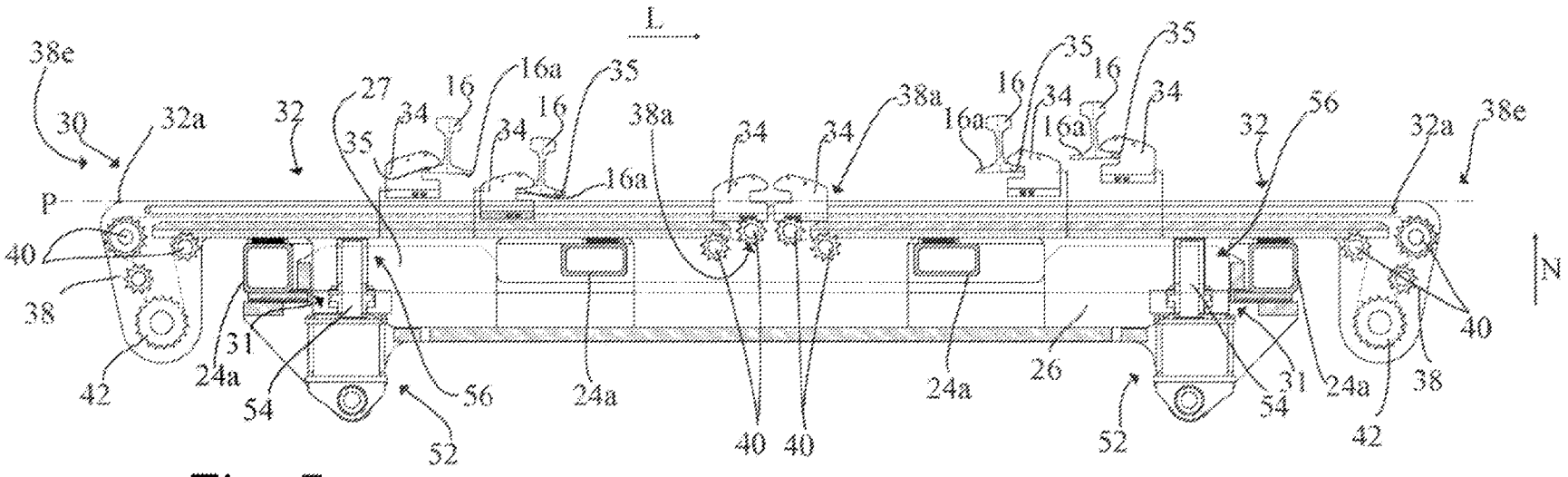
FIG. 5 is a view similar to FIG. 3, illustrating different positions of the attachment member of the securing device according to the invention.
Figure 6:
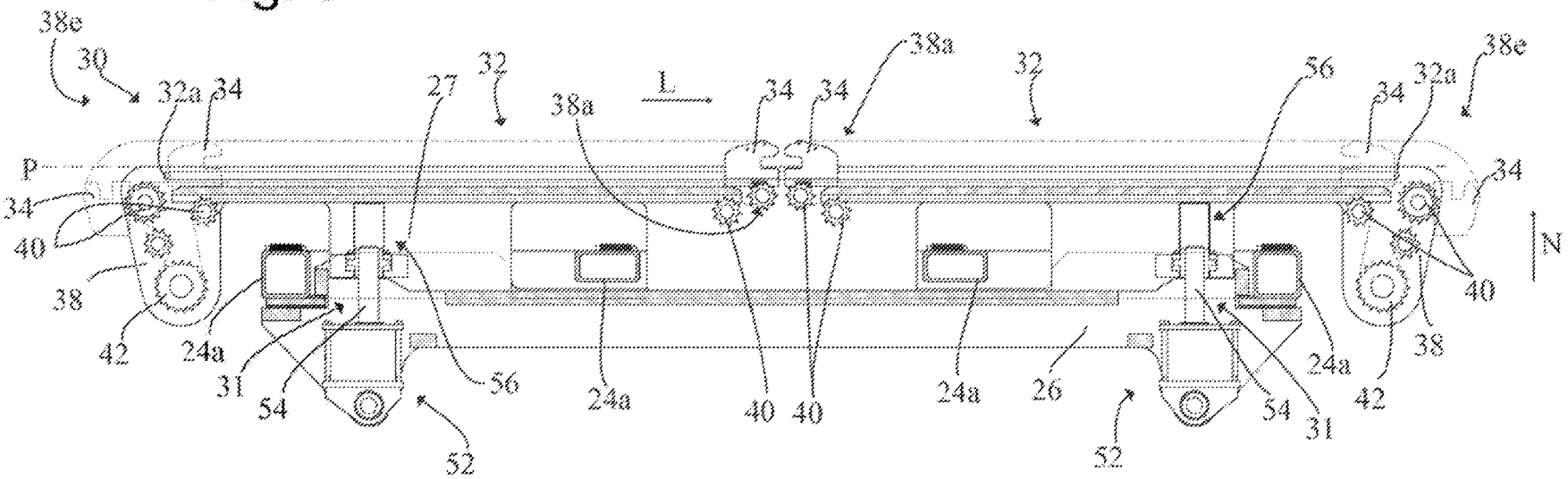
FIG. 6 is a view similar to FIG. 3 illustrating different positions of the attachment members of the securing device according to the invention with the upper beam in a second position.

Another advantage of choosing a screw and nut assembly 52 as the connecting member 31 is that the course of the nut 56 along the screw 54 can be chosen, i.e. its height can be adjusted. Thus, as can be seen in FIG. 5 showing the different heights of the ties 18, and in FIG. 6 showing two different positions of the screw 52 in the thread 54, the hooking areas 35 can be located, in the attachment position, at different heights above the lower beam 26. This allows the mechanism to be used equally with railway apparatuses having either wooden ties 18 (short) or concrete ties 18 (taller). For example, taking into account the usual heights of concrete and wooden ties 18, the travel of the upper beam 27, i.e. of the nut 56 along the screw 54, in this particular embodiment is chosen so that it is at least 130 mm.

In a variant not shown in the drawings, the screw is replaced by a cylinder, and the thread is replaced by a cylinder body.

Due to the self-locking function of the securing mechanism 30 on the one hand and the presence of the locking means 52 of the connecting members 31 on the other hand, the movement of the attachment member 34 is prevented in the longitudinal direction L of the guiding slide 32 and, correspondingly, in the direction N normal to this longitudinal direction. The robustness of the securing of the railway apparatus 12 to the support platform 24 of the securing device 22 is therefore ensured in a simple and reliable manner, as will now be described in accordance with the sequence shown in FIGS. 7 to 9.

Figure 12:
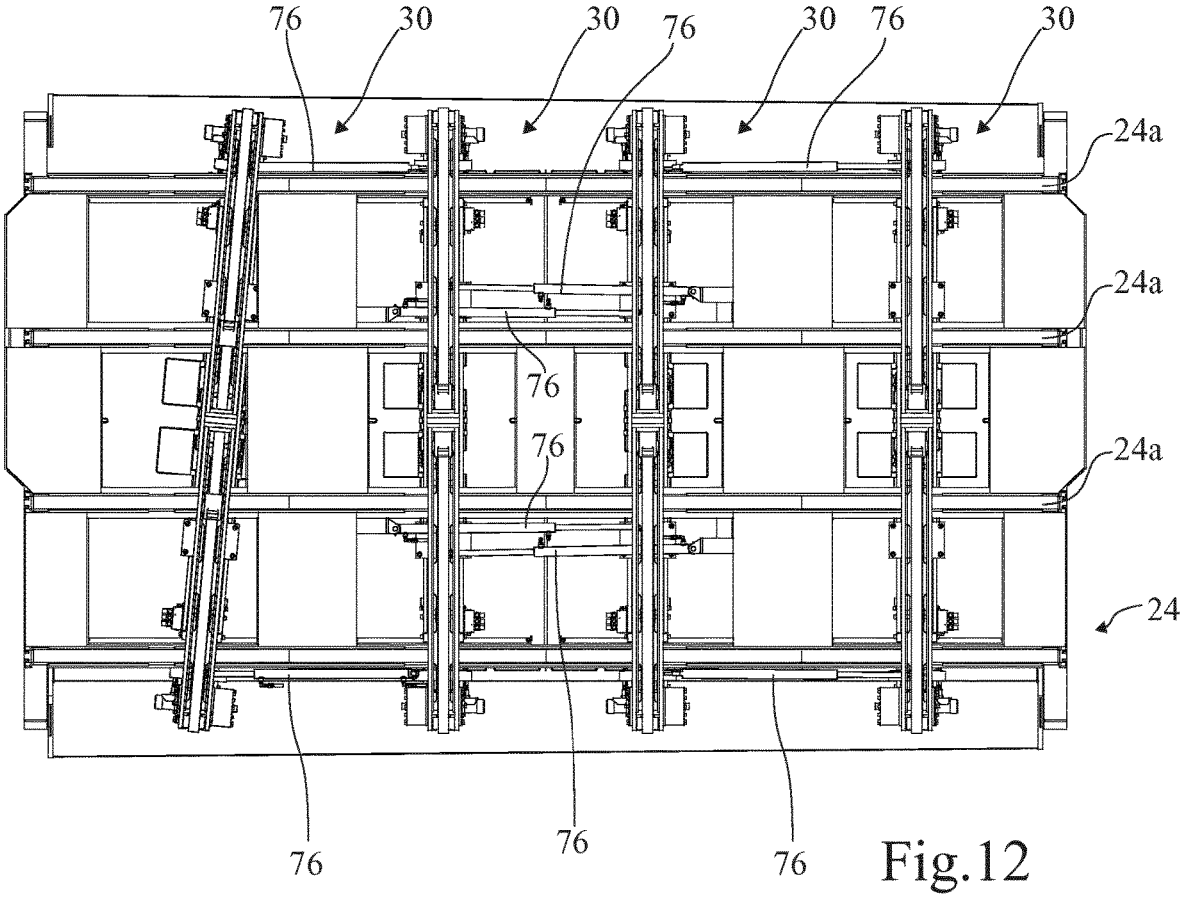
FIG. 12 is a plan view of the wagon for transporting a railway apparatus according to FIG. 1.

As can be seen in FIG. 12, the securing mechanisms 30 are configured to pivot about an axis normal to the plane of the support platform 24, with the pivoting of the securing mechanism 30 being provided, for example, by drive means comprising pivot cylinders 76. The stroke of the cylinders 76 is performed in the plane of the platform 24, transversely to the longitudinal axis ZZ of the wagon 10, for example perpendicularly to this longitudinal axis ZZ.

Figure 7:
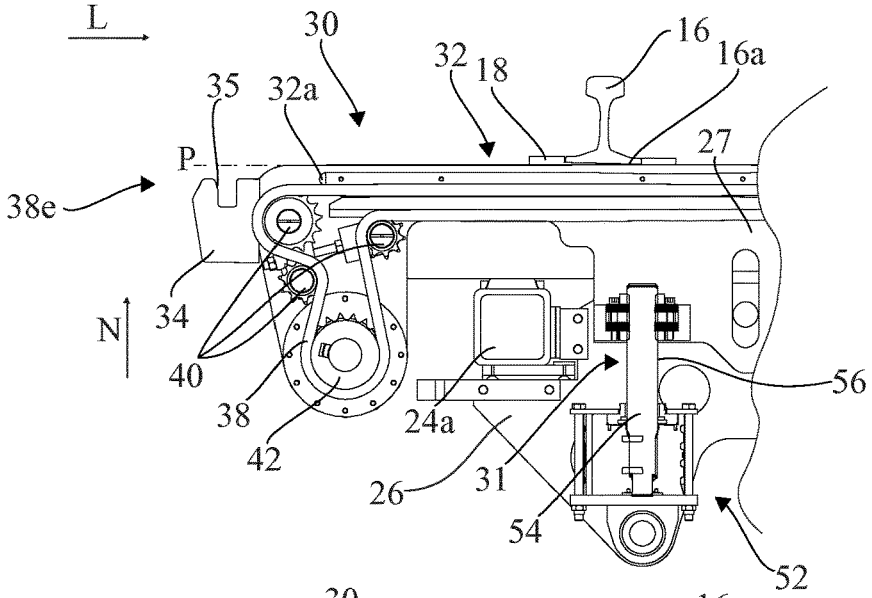
FIGS. 7 to 9 are detail views of FIG. 3 illustrating different positions of the attachment members of the securing device.
Figure 8:
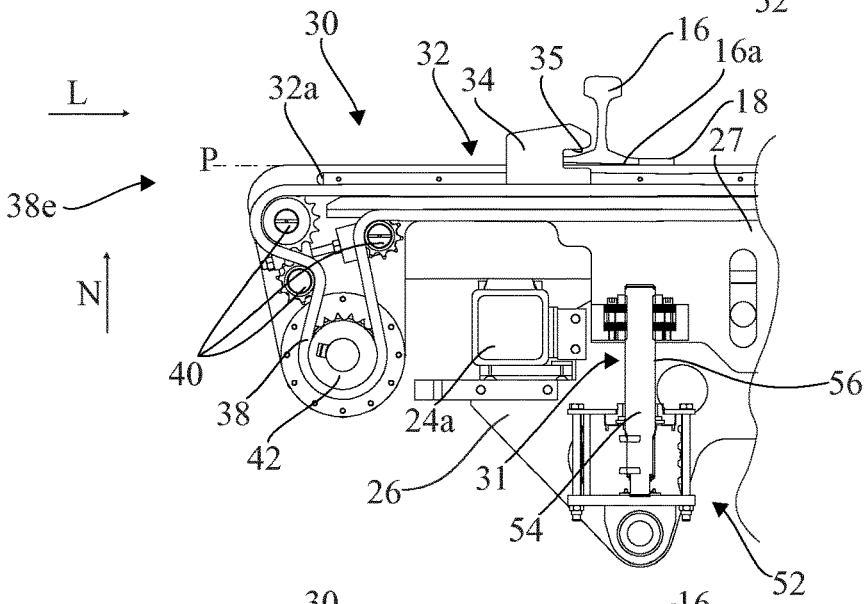
Figure 9:
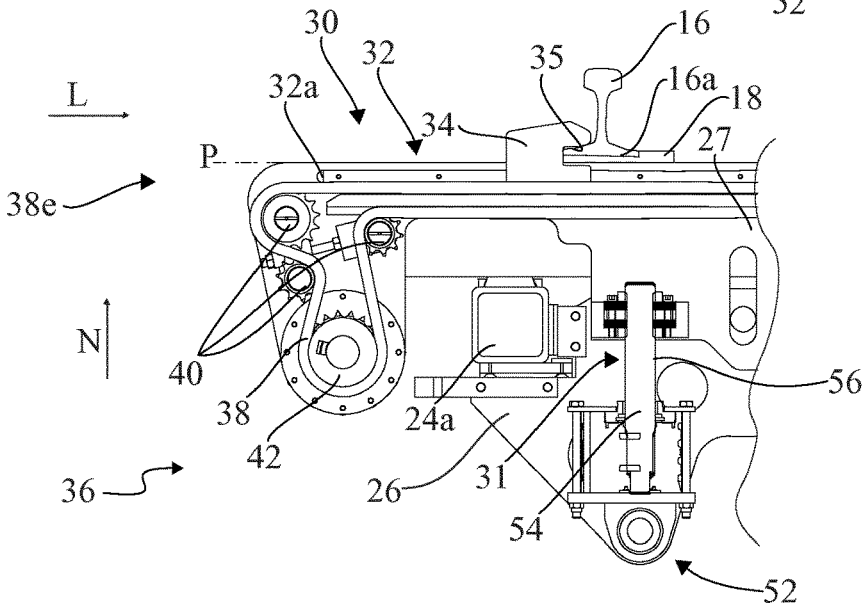

In FIG. 7, the railway apparatus 12, with rail 18 visible, has been laid on the support platform 24. The attachment members 34 are retracted so that they are below the loading plane, shown schematically by the dotted line P in FIG. 7, so as to avoid any interference with the railway apparatus 12 during handling.

To secure a railway apparatus 16 to the platform 24, an operator adjusts the position of the screw 54 in the thread 56 by controlling the associated motor according to the height of the tie 18 so that the securing mechanism 30 makes contact with the foot of the rail 16*a*.

Then, the operator unlocks the braking system 48 and controls motor 46 to allow the drive wheel 42 to be driven, and thus to allow the chain 36 to move along the guiding slide 32. The operator then adjusts the positioning of the attachment members 34 so that they engage with the foot of the rail 18*a* of the railway apparatus 12. At the end of this operation, the securing mechanism 30 is in the transitional position shown in FIG. 8.

Finally, the operator adjusts the position of the screw 54 in the thread 56 by controlling the associated motor until the attachment member 34 exerts a sufficient tightening force on the foot of the rail 16*a*. Preferably, an indicator light indicates that the clamping force has been reached.

Once the railway apparatus 12 has been secured in this way to the support platform 24, the support platform can be lifted into the position shown in FIGS. 1 and 2 for transport.

Unloading operations take place in the reverse order of the loading operations.

If necessary, only one of the two attachment members 34 can be positioned in engagement with one of the rails 18 of the railway apparatus 12, while the other attachment member 34 remains in a free position along the guiding slide 32. Preferably, as shown, two securing mechanisms 30 are provided, the attachment members 34 of which are turned transversely to each other, i.e. in such a way that the hooking areas 35 are facing each other. With this arrangement, when the two attachment members 34 are engaged, the railway apparatus is locked laterally.

Figure 10:
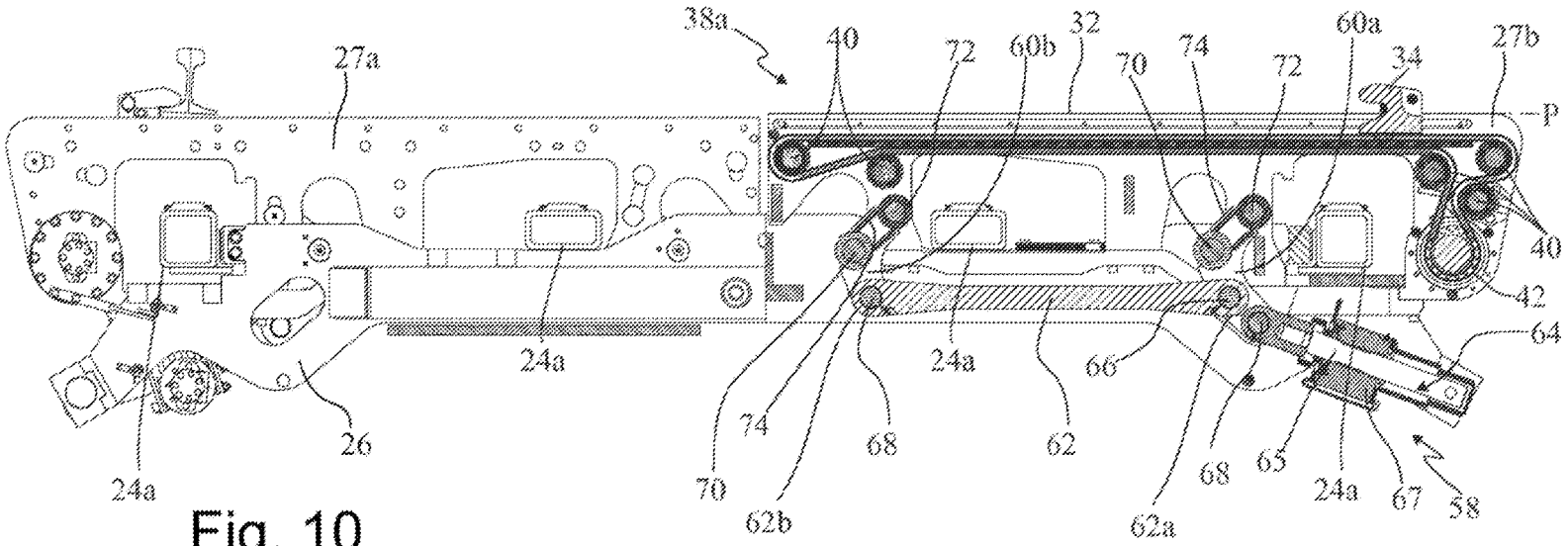
FIG. 10 is a view similar to FIG. 3 of a securing device according to a second embodiment of the invention in a first position.
Figure 11:
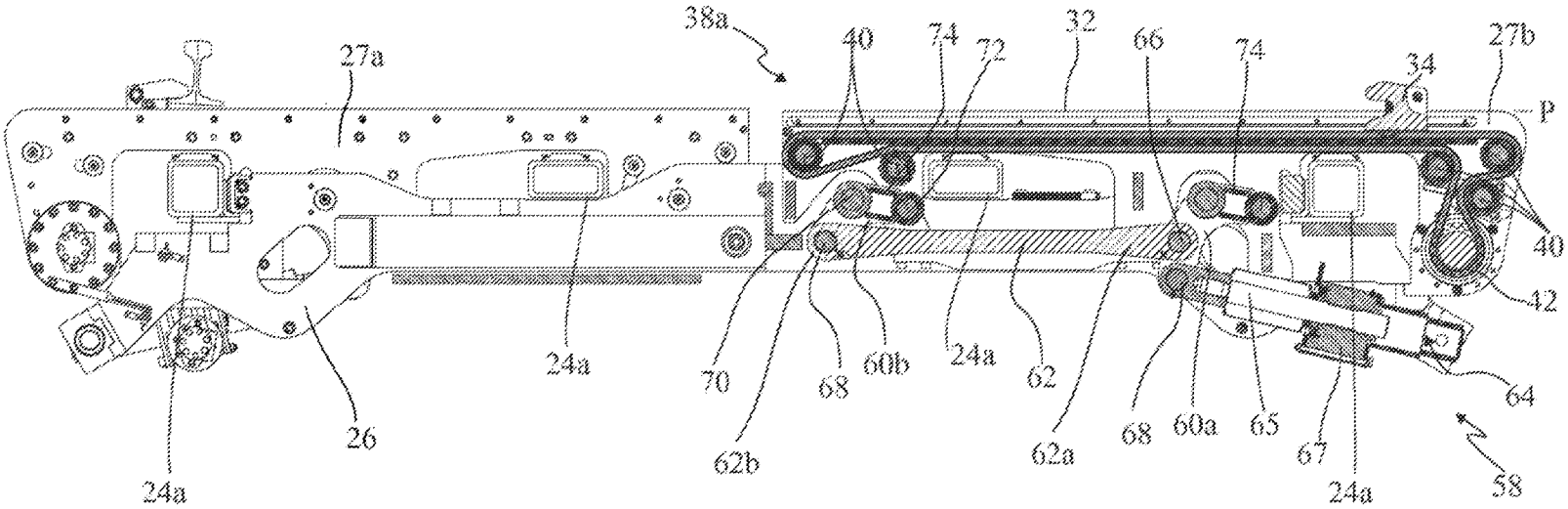
FIG. 11 is a view similar to FIG. 10 of a securing device according to a second embodiment of the invention in a second position.

In a second embodiment of the invention illustrated in FIGS. 10 and 11, the securing mechanism 30 differs in that the connecting member 31 is an articulated parallelogram assembly 58 comprising at least one transmission rod 62 connected to the upper beam 27, and a transfer lever 60 connected to the lower beam 29 and controlled by a screw and nut assembly 64, so that the movement of the upper beam 27 is kinematically linked to the displacement of the screw 65 in the nut 67.

More precisely, in the embodiment shown in the drawings, the parallelogram assembly 58 comprises a transmission rod 62 of longitudinal form, extending in a direction substantially parallel to the direction of extent of the upper beam 27 and lower beam 29. The transmission rod 62 is preferably thinned at its centre so as to lighten it. The transmission rod 62 is connected to two transfer levers 60*a*, 60*b*, one at each of its free ends 62*a*, 62*b*. This connection is made, for example, by means of two pins 68 passing through both the transmission rod 62 and the transfer levers 60*a*, 60*b* and extending in a direction normal to the longitudinal direction of the transmission rod 62, i.e. in the plane normal to FIGS. 10 and 11.

The first transfer lever 60*a*, having a C or boomerang shape, is connected at a first end to the screw and nut assembly 64 by a pin 66 extending normal to the longitudinal direction of the transmission rod 62, i.e. in the plane normal to FIGS. 10 and 11. The screw and nut assembly 64 is connected to the upper beam 27 in such a way that the movement of the screw 65 in the nut 67 moves the transfer lever 60*a* in the direction of the upper beam 27. Because the transmission rod 62 is connected to the transfer lever 60*a*, it is also moved upwards in the drawing.

In addition, the transmission rod 62 is also connected at its end 62*a*, again via the transfer lever 60*a*, to the upper beam 27, because the transfer lever 60*a* is connected to the upper beam 27 at its free end opposite to that where it is connected to transmission rod 62. This connection is made by means of a pin 70 also extending normal to the longitudinal direction of the transmission rod 62 passing through the transfer lever 60*a*, itself connected to a pin 72 passing through the upper beam 27, these two pins 70 and 72 being connected by a tube 74. It should be noted that the connection of the two pins 70 and 72 was chosen in the form of a tube so as to reinforce the structure, but it could be of another form.

Symmetrically, the transmission rod 62 is also connected at its opposite end 62*b* via the transfer lever 60*b* (also C-shaped) to the upper beam 27, because the transfer lever 60*b* is also connected to the upper beam 27 by means of a pin 70 also extending normal to the longitudinal direction of the transmission rod 62 and passing through the transfer lever 60*a*, which is in turn connected to a pin 72 passing through the upper beam 27, these two pins 70 and 72 being connected by a tube 74.

In a variant of this second embodiment, not illustrated in the drawings, the screw and nut assembly is replaced by a cylinder and cylinder body assembly.

Furthermore, in this second embodiment shown in FIGS. 10 and 11, the securing mechanism 30 comprises two upper beams 27*a*, 27*b* connected to a lower beam 26, two guiding slides 32, and two connecting members 31 connecting one upper beam 27*a*, 27*b* each to the lower beam 26, the connecting members 31 being capable of being controlled independently. More precisely, the two upper beams 27*a*, 27*b* are preferably each of a length corresponding to half the length of the upper beams 27 shown in the preceding embodiment.

Thus, both ends can be hooked in independently, thus avoiding an overhang, since the clamping force per hook is constant regardless of the position of the hook in the guiding slide. This relieves the user of additional vigilance and allows him to pay less attention. This increases the operating safety.

Naturally, the examples shown in the drawings and discussed above are for illustrative purposes only and are not exhaustive. Various variants are possible.

In particular, the loading and unloading position of the platform is not necessarily horizontal, but can be tilted, naturally less than the transport position.

Furthermore, in practice, the same transport wagon may be equipped with a different number of securing mechanisms than described, these being distributed over the length of the platform, in order to adapt locally to the configuration of the railway assembly.

Other means for driving the attachment member may also be provided, such as a carriage guided by the guiding slide provided with raceways on which rollers or balls associated with the carriage roll, or provided with sliding tracks for feet formed on the carriage.

It is explicitly provided that the different embodiments illustrated can be combined to propose others.

It is emphasised that all features, as they emerge for a person skilled in the art from this description, the drawings and the claims attached hereto, even if in practice they have been described only in conjunction with other specified features, both individually and in any combinations, may be combined with other features or groups of features disclosed here, provided that this has not been expressly excluded or that technical circumstances make such combinations impossible or meaningless.

The invention claimed is:

1. A device for securing a railway apparatus, comprising a support platform for the railway apparatus and at least one mechanism for securing the railway apparatus on the support platform, said securing mechanism being capable of moving from a locking position to an unlocking position and vice versa, the securing mechanism comprising:

at least one guiding slide extending in a longitudinal direction;

at least one attachment member for attaching the railway apparatus to the support platform, which attachment member is capable of moving along the guiding slide;

an upper beam supporting the guiding slide;

a lower beam connected to the support platform;

at least one connecting member connecting the upper beam and the lower beam, the connecting member being configured such that the upper beam is movable relative to the lower beam in a direction perpendicular to the longitudinal direction of the guiding slide; and a locking mechanism for locking said at least one connecting member, said locking mechanism being configured to prevent the movement of the upper beam with respect to the lower beam.

2. The securing device according to claim 1, wherein said at least one connecting member is an assembly forming an articulated parallelogram comprising at least one transmission rod connected to the upper beam and a transfer lever connected to the lower beam and controlled by a screw and nut assembly or a cylinder, so that the upper beam is kinematically linked to the screw moving in the nut or, correspondingly, to a cylinder rod moving into a cylinder body of the cylinder.

3. The securing device according to claim 1, wherein said at least one connecting member is a screw and nut assembly, comprising a screw carried by the lower beam and a nut carried by the upper beam, so that the upper beam is kinematically linked to the nut along the screw and locking is ensured by a tightening torque of the screw and nut assembly.

4. The securing device according to claim 1, wherein said at least one connecting member is a cylinder, comprising a cylinder body carried by the lower beam and a cylinder rod carried by the upper beam, so that the upper beam is kinematically linked to the cylinder rod moving in the cylinder body and so that locking is ensured by a system for locking the rod.

5. The securing device according to claim 2, wherein a travel range of the upper beam relative to the lower beam is at least 130 mm.

6. The securing device according to claim 1, wherein the securing mechanism comprises two upper beams, two guiding slides, and two connecting members each connecting a respective one of the two upper beam to the lower beam, the connecting members being capable of being controlled independently.

7. The securing device according to claim 1, wherein the attachment member is driven along the guiding slide by a drive mechanism.

8. The securing device according to claim 7, wherein the drive mechanism comprises a movable chain capable of moving along the guiding slide, which movable chain is driven by at least two sprockets so that the movable chain forms a loop.

9. The securing device according to claim 8, wherein said at least one of the sprockets, is a drive wheel provided with a drive shaft, said drive shaft being connected to a motor so as to drive the drive wheel in rotation about said drive shaft.

10. The securing device according to claim 9, wherein the drive wheel is provided with a braking system for preventing rotation of the drive wheel about said drive shaft.

11. The securing device according to claim 10, wherein the braking system is configured to release the drive wheel when power is applied to the braking system and to prevent rotation of the drive wheel about said drive shaft in the absence of power applied to the braking system.

12. The securing device according to claim 1, wherein the support platform is movable between the loading position and an inclined transport position.

13. The securing device according to claim 1, wherein the securing mechanism is controlled by a remote control or an emergency remote control in the event of failure of the primary remote control.

14. The securing device according to claim 1, wherein the attachment mechanism is configured to be pivotable about an axis normal to the plane of the support platform, the pivoting of the attachment mechanism being provided for example by drive means comprising cylinders.

15. A vehicle for transporting a railway apparatus, comprising a transport chassis supported by a running gear and a securing device mounted on the transport chassis, the securing mechanism comprising:

at least one guiding slide extending in a longitudinal direction;

at least one attachment member for attaching the railway apparatus to the support platform, which attachment member is capable of moving along the guiding slide;

an upper beam supporting the guiding slide;

a lower beam connected to the support platform;

at least one connecting member connecting the upper beam and the lower beam, the connecting member being configured such that the upper beam is movable relative to the lower beam in a direction perpendicular to the longitudinal direction of the guiding slide; and a locking mechanism for locking said at least one connecting member, said locking mechanism being configured to prevent the movement of the upper beam with respect to the lower beam.

16. A securing device according to claim 3, wherein a travel range of the upper beam relative to the lower beam is at least 130 mm.

17. The securing device according to claim 1, the drive mechanism is self-locking.

18. The securing device according to claim 11, wherein the braking system comprises a pair of brake discs.

19. The securing device according to claim 1, wherein the support platform is movable between the loading position and an inclined transport position by rotation about at least one horizontal pivot axis.

20. The securing device according to claim 14, further comprising drive cylinders for pivoting the attachment mechanism.

* * * * *